US011732455B2

(12) United States Patent
Lee et al.

(10) Patent No.: US 11,732,455 B2
(45) Date of Patent: Aug. 22, 2023

(54) UNPOWERED AUTOMATIC FLUSHING MODULE FOR FLUSH VALVE HAVING INTEGRATED FLUSHING OPENING/CLOSING PORTION

(71) Applicant: AIR VOOM INC., Seoul (KR)

(72) Inventors: Dong Jin Lee, Seoul (KR); Jae Tong Lee, Seoul (KR)

(73) Assignee: AIR VOOM INC., Seoul (KR)

( * ) Notice: Subject to any disclaimer, the term of this patent is extended or adjusted under 35 U.S.C. 154(b) by 144 days.

(21) Appl. No.: 17/600,569

(22) PCT Filed: Mar. 31, 2020

(86) PCT No.: PCT/KR2020/004416
§ 371 (c)(1),
(2) Date: May 4, 2022

(87) PCT Pub. No.: WO2020/204581
PCT Pub. Date: Oct. 8, 2020

(65) Prior Publication Data

US 2022/0275618 A1 Sep. 1, 2022

(30) Foreign Application Priority Data

Apr. 3, 2019 (KR) ..... 10-2019-0038999

(51) Int. Cl.
*E03D 5/02* (2006.01)
*E03D 5/04* (2006.01)
*E03D 3/10* (2006.01)

(52) U.S. Cl.
CPC ..... *E03D 5/04* (2013.01); *E03D 3/10* (2013.01)

(58) Field of Classification Search
CPC ..... E03D 5/022; E03D 5/024; E03D 5/04; E03D 3/10
USPC ..... 4/313, 405, 407–409, 411–412
See application file for complete search history.

(56) References Cited

U.S. PATENT DOCUMENTS 5,369,816 A * 12/1994 Chen ..... E03D 5/04 4/408
2016/0208472 A1* 7/2016 Lee ..... E03D 5/04

FOREIGN PATENT DOCUMENTS

KR 10-0946393 B1 3/2010
KR 10-1071981 B1 10/2011
KR 10-1389941 B1 4/2014
(Continued)

*Primary Examiner* — Tuan N Nguyen
(74) *Attorney, Agent, or Firm* — Goldilocks Zone IP Law

(57) ABSTRACT

An unpowered automatic flushing module for a flush valve having an integrated flushing opening/closing portion is proposed. The module controls time to dispose of toilet paper with feces and flushing of the feces while suctioning air from outside through a toilet paper time adjustment part when a toilet user defecates and leaves a toilet seat, and controls time to dispose of the toilet paper with urine and flushing of the urine so as to flush an amount of water for urination while rapidly suctioning the air from the outside through the toilet paper time adjustment part and a urine flushing adjustment part when the toilet user urinates and leaves the toilet seat, thereby preventing the toilet user from wasting the water by unnecessarily pressing a lever. In addition, the flushing opening/closing portion is integrated into a module of a detection switch instead of fixing to the toilet seat separately.

14 Claims, 10 Drawing Sheets

(56) References Cited

FOREIGN PATENT DOCUMENTS

KR 10-1647808 B1 8/2016

* cited by examiner

UNPOWERED AUTOMATIC FLUSHING MODULE FOR FLUSH VALVE HAVING INTEGRATED FLUSHING OPENING/CLOSING PORTION

TECHNICAL FIELD

The present disclosure relates to an unpowered automatic flushing module for a flush valve and, more particularly, to an unpowered automatic flushing module for a flush valve having an integrated flushing opening/closing portion, wherein the module controls time to dispose of toilet paper with feces and flushing of the feces while suctioning air from outside through a toilet paper time adjustment part when a toilet user defecates and leaves a toilet seat, and controls time to dispose of the toilet paper with urine and flushing of the urine to flush an amount of water for urination while rapidly suctioning the air from the outside through the toilet paper time adjustment part and a urine flushing adjustment part when the toilet user urinates and leaves the toilet seat, thereby preventing the toilet user from wasting water by unnecessarily pressing a lever, the flushing opening/closing portion is integrated into a module of a detection switch instead of fixing to the toilet seat separately, thereby reducing manufacturing costs by reducing the number of components and at the same time prevent the occurrence of injection molding tolerances and assembly tolerances of the toilet seat in advance, and an opening/closing valve part of the flushing opening/closing portion is operated upward and downward by a weight load of the human body and a water drain hole is opened in advance while a water supply hole is closed with that force of the weight load, thereby flushing a toilet by stably draining the water stored in a pressure chamber of the flush valve regardless of high water pressure.

BACKGROUND ART

In general, a toilet bowl is installed in a bathroom in a home or building, and is configured such that after excretion of a toilet user, the flushing water that is drained by a lever moved by the toilet user and the excreta of the toilet user are discharged into a septic tank. An unpowered automatic flushing device in which the flushing of water is automatically operated by applying water pressure has been registered as Korean Patent No. 10-0946393.

The previously registered patent has a configuration for flushing feces or urine with the flushing water, wherein when a toilet seat is sat on by a toilet user, the water from a faucet is supplied to an operation part through a water channel that is opened by the weight load of the toilet user and a cylinder rod moves while compressing a spring with pressure of water supplied to the operation part, and simultaneously the water that has moved the cylinder rod by restoring force of the compressed spring is supplied to a flushing device, whereby the excreta of feces and urine is flushed by the flushing water discharged from the flushing device.

However, in the previously registered patent, when water pressure of the water supplied from the faucet is weaker than the spring tension, the water pressure is unable to press and move the cylinder rod, so the function of the automatic flushing device is lost due to the fact that flushing does not work and the urination and defecation of the toilet user are not determined, thereby causing a problem of lowering toilet user's trust in the product.

In addition, in a case where excreta is flushed in a public toilet having multiple toilet bowls at the same time, as water pressure decreases while water is supplied to the toilet bowls, the amount of water that is for flushing urine is discharged for flushing feces because the cylinder rod does not advance as much as a position for determining defecation, thereby causing problems such that unflushed feces may cause clogging of the toilet bowls or generating of odors, inconvenience occurs such that the water has to be flushed once more by manually pressing the lever in order to flush the remnants of the feces, and it is not only uneconomical due to wasting of the water but also unsanitary.

In addition, there are problems that since the configuration of the operation part operated by hydraulic pressure is complicated, productivity is reduced and manufacturing cost is increased, thereby decreasing economic feasibility, and also there are problems that many components of the configuration cause not only a malfunction due to accumulation of foreign substances in a water passage but also a water leakage through the connection areas.

In order to solve the above problems, recently, Korean Patent No. 10-1071981 has been registered, wherein a toilet seat is able to automatically flush a toilet after distinguishing urination and defecation by using only energy of weight load of the human body.

In the previously registered patent, as a gap between a first and second tension load rollers is narrowed while a toilet seat descends by the weight load of a toilet user seated on the toilet seat, when a tension load force of a tension load wire is lost and at the same time a detachable member fixed to a tension load wire fixing member presses a feces and urine distinction determination part while moving because the toilet seat descends, it is determined as urination, and also when the cylinder rod presses the feces and urine distinction determination part, it is determined as defecation. In such a state, as the gap between the first and second tension load rollers is widened by the restoring force of the toilet seat as the toilet user leaves the toilet seat, the tension load wire is tense and simultaneously the flushing wire is pulled, so the flushing water corresponding to the defecation and urination is discharged to a toilet body to flush the feces and urine, and thus the conventional problems may be solved.

However, in the previously registered patent, in a case where fluid is supplied to a cylinder by the weight load of the toilet user who sits and leaves the toilet seat, since a fluid movement structure is complicated and the number of components increases, there are problems that not only the assembly is difficult but also the economic feasibility is decreased due to the increase in the manufacturing cost.

In addition, there are problems that the maintenance is difficult and a defect rate is high due to the risk of fluid leaking through the connection areas of the components, the operation time varies depending on a viscosity difference depending on the amount of oil injection and the temperature change, and on/off errors of a water passage opening/closing valve mounted separately causes no flushing or continuous flushing, whereby the toilet user loses trust in the product.

In order to solve the above problems, an unpowered automatic flushing toilet seat for a flush valve that is provided with a control function of discharging and intaking air only with weight load of the human body has been registered in Korean Patent No. 10-1389941.

In the previously registered patent, when a toilet user is seated on a toilet seat, a tension load member retains a tension load force for pulling a flushing wire in conjunction with descending motion of the toilet seat, and when the toilet user leaves the toilet seat, not only the flushing wire that is pulled in conjunction with ascending motion of the toilet seat rotates a siphon cover upward while the flushing water from a tank is discharged into a toilet bowl through an opened water drain hole to flush the excreta, but also the operation time of flushing is controlled by adjusting the amount of air suctioned into a toilet paper time adjustment part, and thus the conventional problems may be solved.

However, in the previously registered patent, the tension load force capable of pulling the flushing wire may be retained in the tension load member by the descending motion of the toilet seat, but according to the rotational movement of the lever, friction and load of the tension load wire that pulls the tension load member occur, so power conveyance efficiency is decreased, and the siphon cover may not be sufficiently lifted. Accordingly, since the flushing water stored in the tank is not discharged smoothly, the flushing power for excreta is decreased and the remnants of feces or foreign substances remain in the toilet bowl, so as to result in clogging the toilet bowl or generating the odors, thereby causing the problem of lowering the toilet user's trust in the product.

In addition, the siphon cover should be operated in a way of being sufficiently lifted so that the flushing water may be discharged smoothly, but due to the height of the toilet seat, there are problems of causing inconvenience to the toilet user and being subject to design limitation of the toilet seat. Further, there are problems that as the number of components increases, the assembly becomes difficult, so not only the working time increased, but also the economic feasibility is decreased due to the increase of the manufacturing cost.

In order to solve the above problems, recently, an unpowered automatic flushing toilet seat for a flush valve, the toilet seat having the detachable and waterproof functions, has been registered in Korean Patent No. 10-1647808.

In the previously registered patent, due to the descending movement of the toilet seat, a toilet paper time tension load member is caught in a locking groove of a water drain guide member to control the movement while the flushing tension load member is compressed and retains the tension load force capable of pressurizing a guide member, and due to the ascending movement of the toilet seat, the toilet paper time tension load member is separated from the locking groove. At the same time, the water stored in a pressure chamber of the flush valve is drained as the guide member moves by the tension load force of the flushing member, so that not only the water from the faucet is supplied to the toilet body to flush the excreta, but also a tension load release member presses a tension load control member, whereby it is easy to secure the time to dispose of toilet paper of the toilet user because the loaded state of the tension load member is maintained until a supporting force of the flushing tension load member and the toilet paper time tension load member is released, and thus the conventional problems may be solved.

However, in the previously registered patent, since the flushing opening/closing portion is separately configured and fixed to a seating switch, a setting value is changed due to injection molding tolerances and assembly tolerances, whereby there is a problem that the assembly efficiency is remarkably reduced.

In addition, such a flushing opening/closing portion uses a method of opening an opening/closing valve by a tension load force of the tension load member, the tension load force being loaded when water is flushed. When the tension load member is used as a plate, the tension load member has the restoring force that is remarkably low to such an extent that flushing of the toilet is unable to be performed. Alternately, the water pressure is too strong at high water pressure and the water may not be flushed smoothly, whereby the water should be flushed by applying a pressure reducing valve. Therefore, there are problems that the manufacturing cost is increased due to the increase in the number of components, and thus the product quality is lowered.

In addition, since the time to dispose of toilet paper when used for defecation and urination is applied the same way, the time to dispose of toilet paper for the urination becomes even longer than before, thereby causing inconvenience of the user to manually flush the water and reducing the trust of the product.

DISCLOSURE

Technical Problem

The present disclosure has been devised in consideration of the various conventional problems as described above, and an objective of the present disclosure is to provide an unpowered automatic flushing module for a flush valve having an integrated flushing opening/closing portion, wherein the module controls the time to dispose of toilet paper with feces and the flushing of the feces while suctioning air from outside through a toilet paper time adjustment part when a toilet user defecates and leaves a toilet seat, and controls the time to dispose of the toilet paper with urine and the flushing of the urine to flush an amount of water for urination while rapidly suctioning the air from the outside through the toilet paper time adjustment part and a urine flushing adjustment part when the toilet user urinates and leaves the toilet seat, thereby preventing the toilet user from wasting the water by unnecessarily pressing a lever.

In addition, another objective of the present disclosure is to provide an unpowered automatic flushing module for a flush valve having an integrated flushing opening/closing portion, wherein the flushing opening/closing portion is integrated into a module of a detection switch instead of fixing to the toilet seat separately, thereby reducing manufacturing costs by reducing the number of components, and at the same time shortening the working process and working time by simplifying installation works.

In addition, yet another objective of the present disclosure is to provide an unpowered automatic flushing module for a flush valve having an integrated flushing opening/closing portion, wherein since water stored in a pressure chamber of a flush valve is drained by operating the opening/closing valve part of the flushing opening/closing portion upward and downward, the unpowered automatic flushing module may be used stably while preventing malfunction.

In addition, still another objective of the present disclosure is to provide an unpowered automatic flushing module for a flush valve having an integrated flushing opening/closing portion, wherein since a water supply hole is closed by the weight load of the human body and a water drain hole is opened in advance, the toilet flushing may be used stably without using a pressure reducing valve and the like even at high water pressure and without having a change in the tension load member even when used for a long period of time.

Technical Solution

According to the present disclosure, an unpowered automatic flushing module for a flush valve having an integrated flushing opening/closing portion configured integrally with a detection switch module includes:

the detection switch configured to guide descending motion of a toilet seat under a weight load of a toilet user, and allow the toilet seat to ascend when the pressurized weight load is released as the toilet user leaves the toilet seat;

a toilet paper time control and flushing adjustment part configured to discharge air inside a guide rib while a flushing adjustment part in conjunction with the descending motion of the toilet seat ascends, and control time to dispose of toilet paper with feces and time to flush the feces while suctioning the air from outside through a toilet paper time adjustment hole and a feces flushing adjustment hole with a restoring force of a restoration spring when the toilet user leaves the toilet seat after defecation; and the flushing opening/closing portion configured such that when the toilet seat is descending, a first opening/closing valve and a second opening/closing valve ascend at the same time by the detection switch, so as to close a water supply hole by the first opening/closing valve and open a water drain hole by the second opening/closing valve, thereby preparing to drain water from a pressure chamber into a toilet body and allowing a rotation release member to be inserted to support an opening/closing pin of the first opening/closing valve and a water drain valve body of the second opening/closing valve, the flushing opening/closing portion being configured such that when the detection switch is restored due to leaving of the toilet user from the toilet seat, the rotation release member is pressed while the opening/closing pin of the first opening/closing valve and the water drain valve body of the second opening/closing valve descend, and the rotation release member is rotated while a pressurization release piece of the toilet paper time control and flushing adjustment part descends, thereby controlling toilet paper time until the opening/closing pin of the first opening/closing valve is released, the flushing opening/closing portion being configured such that when the opening/closing pin of the first opening/closing valve being pressurized is released by rotating the rotation release member while the pressurization release piece of the toilet paper time control and flushing adjustment part descends, since the water supply hole is opened regardless of high water pressure and simultaneously the water drain valve body of the second opening/closing valve opens the water drain hole, thereby flushing a toilet while draining the water stored in the pressure chamber of a flush valve into the toilet body, and the flushing opening/closing portion being configured such that when a pressurizing force of the water drain valve body of the second opening/closing valve is released by rotating the rotation release member while the pressurization release piece of the toilet paper time control and flushing adjustment part is descending, the water stored in the pressure chamber of the flush valve is prevented from being drained, thereby stopping the toilet flushing.

In addition, according to the present disclosure, an unpowered automatic flushing module for a flush valve having an integrated flushing opening/closing portion configured integrally with a detection switch module includes:

the detection switch configured to guide descending motion of a toilet seat under a weight load of a toilet user, and allow the toilet seat to ascend when the pressurized weight load is released as the toilet user leaves the toilet seat;

a toilet paper time control and flushing adjustment part configured to discharge air inside a guide rib while a urine flushing adjustment and a flushing adjustment part in conjunction with the descending motion of the toilet seat ascends, control time to dispose of toilet paper with feces and the flushing of the feces while suctioning the air from outside through a toilet paper time adjustment hole and a feces flushing adjustment hole with a restoring force of a restoration spring when the toilet user leaves the toilet seat after defecation, and control the urine toilet paper time and urine flushing while rapidly suctioning the air from the outside through the toilet paper time adjustment hole, the feces flushing adjustment hole, and a urine flushing adjustment hole when the toilet user leaves the toilet seat after urination;

a feces and urine distinction part configured to adjust an amount of internal air discharged to the outside while a guide rod moves into a distinction guide rib in conjunction with the descending motion of the toilet seat, determine as urination when a urine flushing adjustment hole is opened because a feces and urine determination member fails to press the urine flushing determination pin, and determine as defecation when the feces and urine determination member closes the urine flushing adjustment hole by pressing the urine flushing determination pin; and the flushing opening/closing portion configured such that when the toilet seat is descending, a first opening/closing valve and a second opening/closing valve ascend at the same time by the detection switch, so as to close a water supply hole by the first opening/closing valve and open a water drain hole by the second opening/closing valve, thereby preparing to drain water from a pressure chamber into a toilet body and allowing a rotation release member to be inserted to support an opening/closing pin of the first opening/closing valve and a water drain valve body of the second opening/closing valve, the flushing opening/closing portion being configured such that when the detection switch is restored due to leaving of the toilet user from the toilet seat, the rotation release member is pressed while the opening/closing pin of the first opening/closing valve and the water drain valve body of the second opening/closing valve descend, and the rotation release member is rotated while a pressurization release piece of the toilet paper time control and flushing adjustment part descends, thereby controlling toilet paper time until the opening/closing pin of the first opening/closing valve is released, the flushing opening/closing portion being configured such that when the opening/closing pin of the first opening/closing valve being pressurized is released by rotating the rotation release member while the pressurization release piece of the toilet paper time control and flushing adjustment part descends, since the water supply hole is opened regardless of high water pressure and simultaneously the water drain valve body of the second opening/closing valve opens the water drain hole, thereby flushing a toilet while draining the water stored in the pressure chamber of a flush valve into the toilet body, and the flushing opening/closing portion being configured such that when a pressurizing force of the water drain valve body of the second opening/closing valve is released by rotating the rotation release member while the pressurization release piece of the toilet paper time control and flushing adjustment part is descending, the water stored in the pressure chamber of the flush valve is prevented from being drained, thereby stopping the toilet flushing.

Advantageous Effects

According to the present disclosure, there is provided an advantage that the unpowered automatic flushing module for a flush valve controls the time to dispose of toilet paper with feces and the flushing of the feces while suctioning air from outside through a toilet paper time adjustment part when a toilet user defecates and leaves a toilet seat, and controls the time to dispose of the toilet paper with urine and the flushing of the urine to flush an amount of water for urination while rapidly suctioning the air from the outside through the toilet paper time adjustment part and a urine flushing adjustment part when the toilet user urinates and leaves the toilet seat, so as to prevent the toilet user from wasting the water by unnecessarily pressing a lever, thereby improving the trust of the product.

In addition, according to the present disclosure, there is provided an advantage that a flushing opening/closing portion is integrated into a module of a detection switch instead of fixing to a toilet seat separately, so as to reduce manufacturing costs by reducing the number of components and at the same time prevent the occurrence of injection molding tolerances and assembly tolerances in advance, whereby assembly properties is improved and the working time is shortened.

In addition, according to the present disclosure, there is provided an advantage that since water stored in a pressure chamber of a flush valve is drained by operating the opening/closing valve part of the flushing opening/closing portion upward and downward, the unpowered automatic flushing module may be used stably while preventing malfunction.

In addition, according to the present disclosure, there is provided an advantage that since a water supply hole is closed by the weight load of the human body and a water drain hole is opened in advance, the toilet flushing may be used stably without using a pressure reducing valve and the like even at high water pressure and without having a change in the tension load member even when used for a long period of time.

MODE FOR INVENTION

Figure 1:
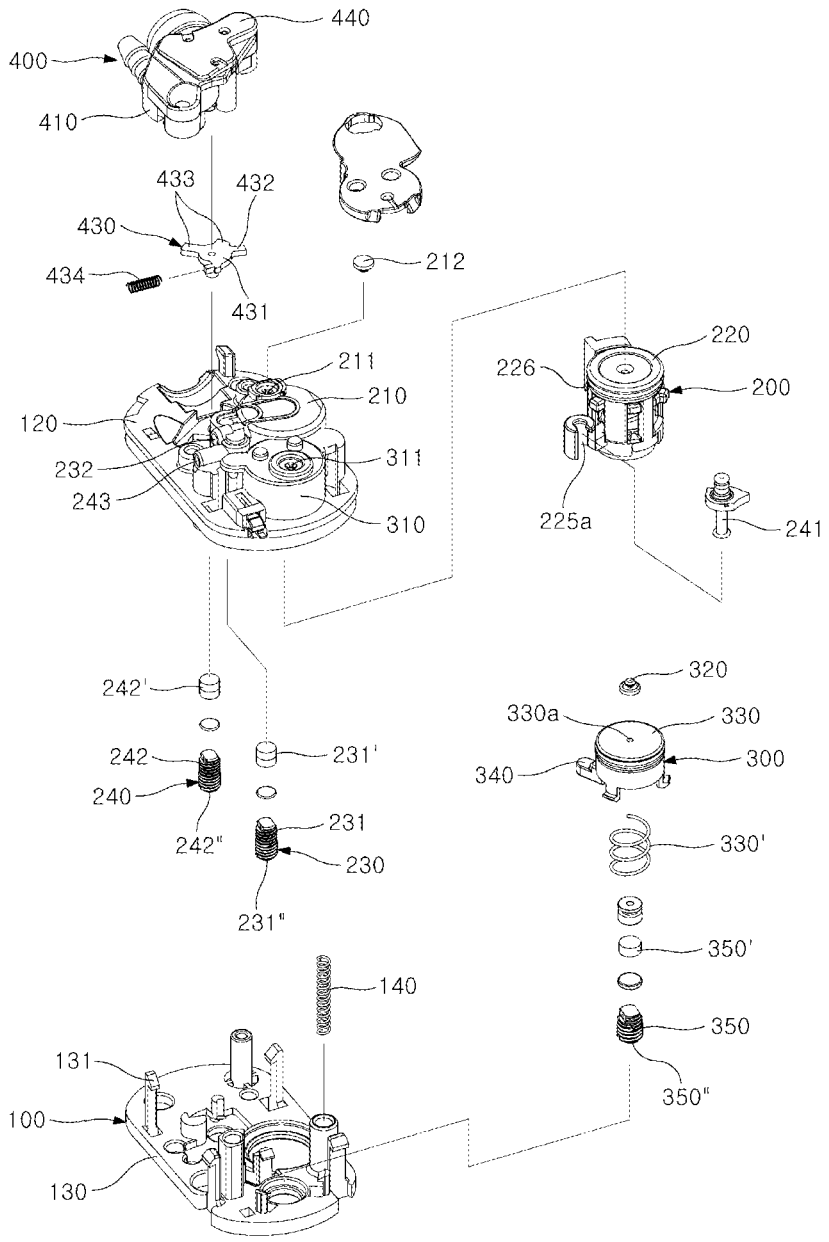
FIG. 1 is an exploded perspective view of the present disclosure.
Figure 2:
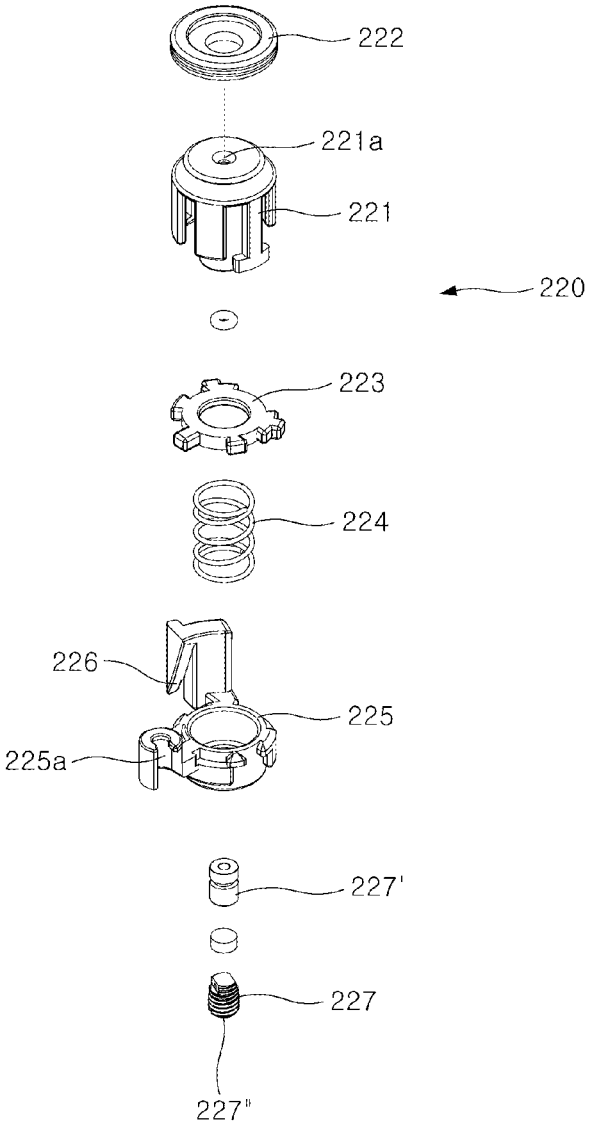
FIG. 2 is an exploded perspective view illustrating a flushing adjustment part of the present disclosure.
Figure 3:
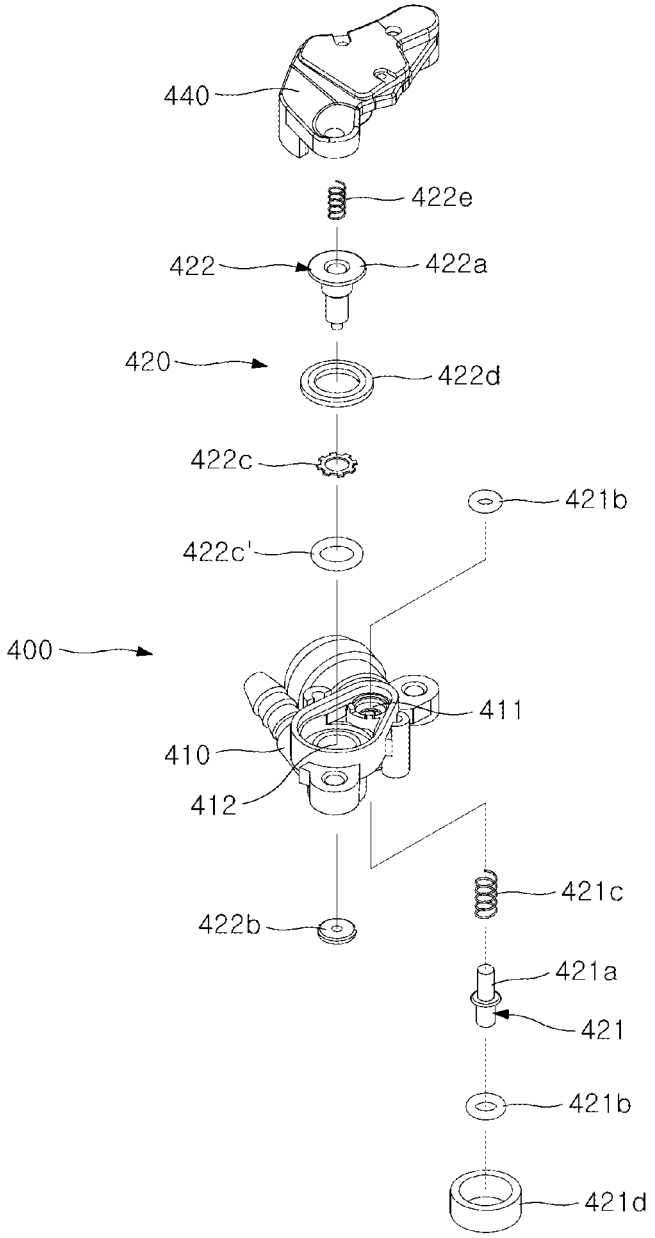
FIG. 3 is an exploded perspective view illustrating a flushing opening/closing portion of the present disclosure.
Figure 4:
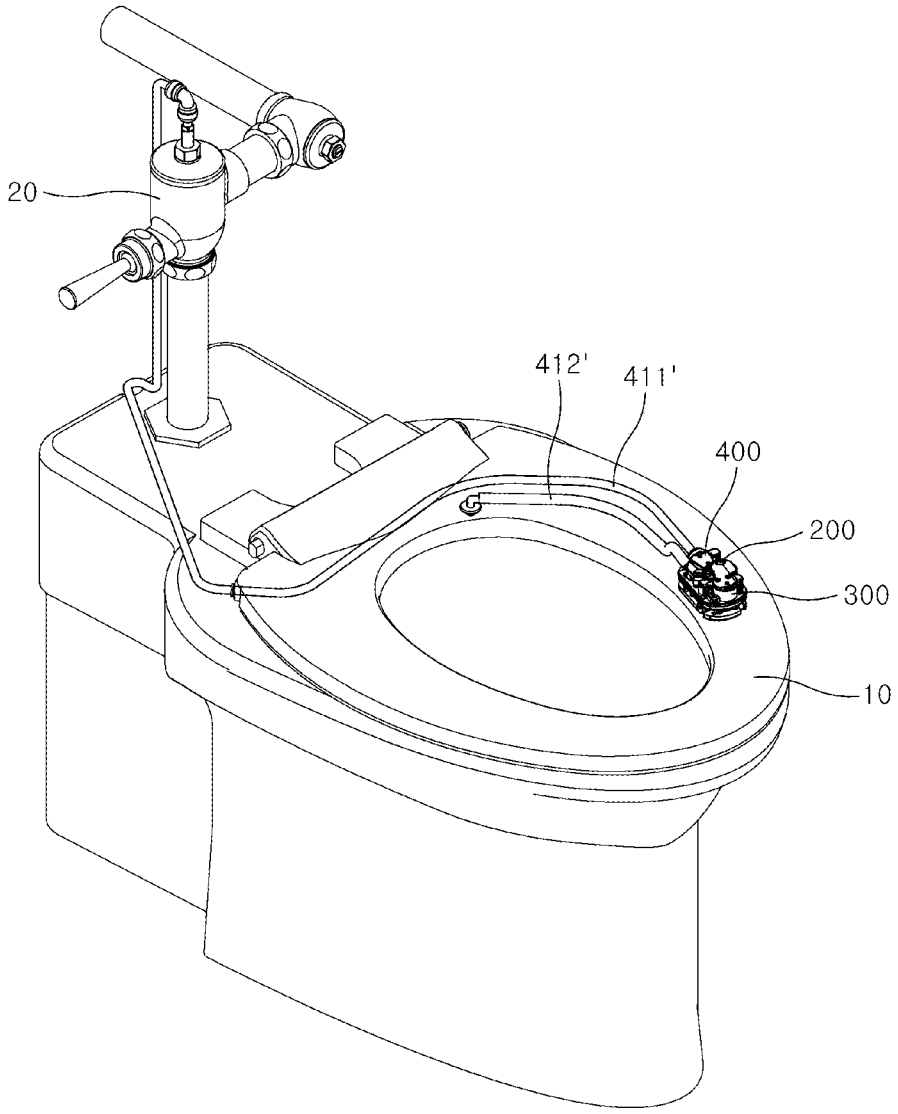
FIG. 4 is a view illustrating an installation state of the present disclosure.

Hereinafter, the present disclosure will be described in detail on the basis of the accompanying drawings. FIG. 1 is an exploded perspective view of the present disclosure, FIG. 2 is an exploded perspective view illustrating a flushing adjustment part of the present disclosure, and FIG. 3 is an exploded perspective view illustrating a flushing opening/closing portion of the present disclosure.

According to the present disclosure, the unpowered automatic flushing module for a flush valve having an integrated flushing opening/closing portion configured integrally with a detection switch 100 module includes: a detection switch 100 configured to guide the descending motion of a toilet seat 10 under a weight load of a toilet user, and allow the toilet seat 10 to ascend when the pressurized weight load is released as the toilet user leaves the toilet seat 10; a toilet paper time control and flushing adjustment part 200 configured to discharge air inside a guide rib 210 while a flushing adjustment part 220 in conjunction with the descending motion of the toilet seat 10 ascends, and control the time to dispose of toilet paper with feces and time to flush the feces while suctioning air from the outside through a toilet paper time adjustment hole 231" and the feces flushing adjustment hole 227" with a restoring force of a restoration spring 224 when the toilet user leaves the toilet seat after defecation; and a flushing opening/closing portion 400 configured such that when the toilet seat 10 is descending, a first opening/closing valve 421 and a second opening/closing valve 422 ascend at the same time by the detection switch 100, so as to close a water supply hole 411 by the first opening/closing valve 421 and open a water drain hole 412 by the second opening/closing valve 422, thereby preparing to drain water from a pressure chamber into a toilet body and allowing a rotation release member 431 to be inserted thereto to support an opening/closing pin 421*a* of the first opening/closing valve 421 and a water drain valve body 422*a* of the second opening/closing valve 422, the flushing opening/closing portion 400 being configured such that when the detection switch 100 is restored due to the leaving of the toilet user from the toilet seat, the rotation release member 431 is pressed while the opening/closing pin 421*a* of the first opening/closing valve 421 and the water drain valve body 422*a* of the second opening/closing valve 422 descend, and the rotation release member 431 is rotated while a pressurization release piece 226 of the toilet paper time control and flushing adjustment part 200 descends, thereby controlling toilet paper time until the opening/closing pin 421*a* of the first opening/closing valve 421 is released, the flushing opening/closing portion 400 being configured such that when an opening/closing pin 421*a* of the first opening/closing valve 421 being pressurized is released by rotating the rotation release member 431 while a pressurization release piece 226 of the toilet paper time control and flushing adjustment part 200 descends, since the water supply hole 411 is opened regardless of high water pressure and simultaneously the water drain valve body 422*a* of the second opening/closing valve 422 opens the water drain hole 412, thereby flushing a toilet while draining the water stored in the pressure chamber of a flush valve 20 into the toilet body, and the flushing opening/closing portion 400 being configured such that when a pressurizing force of the water drain valve body 422*a* of the second opening/closing valve 422 is released by rotating the rotation release member 431 while the pressurization release piece 226 of the toilet paper time control and flushing adjustment part 200 is descending, the water stored in the pressure chamber of the flush valve 20 is prevented from being drained, thereby stopping the toilet flushing.

In addition, according to the present disclosure, the unpowered automatic flushing module for a flush valve having an integrated flushing opening/closing portion configured integrally with a detection switch 100 module includes: a detection switch 100 configured to guide the descending motion of a toilet seat 10 under a weight load of a toilet user, and allow the toilet seat 10 to ascend when the pressurized weight load is released as the toilet user leaves the toilet seat 10; a toilet paper time control and flushing adjustment part 200 configured to discharge air inside a guide rib 210 while a urine flushing adjustment 240 and a flushing adjustment part 220 in conjunction with the descending motion of the toilet seat 10 ascends, control the time to dispose of toilet paper with feces and the flushing of the feces while suctioning air from the outside through a toilet paper time adjustment hole 231" and the feces flushing adjustment hole 227" with a restoring force of a restoration spring 224 when the toilet user leaves the toilet seat after defecation, and control the urine toilet paper time and urine flushing while rapidly suctioning the air from the outside through the toilet paper time adjustment hole 231", the feces flushing adjustment hole 227", and the urine flushing adjustment hole 242" when the toilet user leaves the toilet seat after urination; a feces and urine distinction part 300 configured to adjust an amount of internal air discharged to the outside while a guide rod 330 moves into a distinction guide rib 310 in conjunction with the descending motion of the toilet seat 10, determine as urination when a urine flushing adjustment hole 243 is opened because the feces and urine determination member 340 fails to press the urine flushing determination pin 241, and determine as defecation when the feces and urine determination member 340 closes the urine flushing adjustment hole 243 by pressing the urine flushing determination pin 241; and a flushing opening/closing portion 400 configured such that when the toilet seat 10 is descending, a first opening/closing valve 421 and a second opening/closing valve 422 ascend at the same time by the detection switch 100, so as to close a water supply hole 411 by the first opening/closing valve 421 and open a water drain hole 412 by the second opening/closing valve 422, thereby preparing to drain water from a pressure chamber into a toilet body and allowing a rotation release member 431 to be inserted to support an opening/closing pin 421*a* of the first opening/closing valve 421 and a water drain valve body 422*a* of the second opening/closing valve 422, the flushing opening/closing portion 400 being configured such that when the detection switch 100 is restored due to the leaving of the toilet user from the toilet seat, the rotation release member 431 is pressed while the opening/closing pin 421*a* of the first opening/closing valve 421 and the water drain valve body 422*a* of the second opening/closing valve 422 descend, and the rotation release member 431 is rotated while a pressurization release piece 226 of the toilet paper time control and flushing adjustment part 200 descends, thereby controlling the toilet paper time until the opening/closing pin 421*a* of the first opening/closing valve 421 is released, the flushing opening/closing portion 400 being configured such that when an opening/closing pin 421*a* of the first opening/closing valve 421 being pressurized is released by rotating the rotation release member 431 while a pressurization release piece 226 of the toilet paper time control and flushing adjustment part 200 descends, since the water supply hole 411 is opened regardless of high water pressure and simultaneously the water drain valve body 422*a* of the second opening/closing valve 422 opens the water drain hole 412, thereby flushing the toilet while draining the water stored in the pressure chamber of a flush valve 20 into the toilet body, and the flushing opening/closing portion 400 being configured such that when the pressurizing force of the water drain valve body 422*a* of the second opening/closing valve 422 is released by rotating the rotation release member 431 while the pressurization release piece 226 of the toilet paper time control and flushing adjustment part 200 is descending, the water stored in the pressure chamber of the flush valve 20 is prevented from being drained, thereby stopping the toilet flushing.

The detection switch 100 is configured to include: an installation hole 110 formed on a toilet seat; a cover 120 mounted on the installation hole 110 so as to allow a hook 131 protruding from a detection plate 130 to be coupled to a hook coupling hole 121 penetrating the cover 120; the detection plate 130 mounted to a toilet body as the hook 131 is coupled to the hook coupling hole 121 penetrating the cover 120; and a seat spring 140 mounted between the cover 120 and the detection plate 130.

The toilet paper time control and flushing adjustment part 200 includes: a guide rib 210 configured to protrude from the cover 120 of the detection switch 100, have an inflow check valve 212 to open and close a discharge through-hole 211 penetrating therein, and have an inner bottom surface thereof from which a toilet paper time and flushing distinction protrusion 213 protrudes; a flushing adjustment part 220 configured to be embedded in the guide rib 210, discharge the air inside the guide rib 210 to the inflow check valve 212 that is opened in conjunction with the descending motion of the toilet seat, control the amount of air introduced into the guide rib 210 while the inflow check valve 212 closes the discharge through-hole 211 in conjunction with the ascending motion of the toilet seat; a toilet paper time adjustment part 230 configured to be mounted on the guide rib 210 on one side of the flushing adjustment part 220 and adjust the amount of the air introduced into the guide rib 210; and a urine flushing adjustment part 240 configured to ascend and descend by the feces and urine determination member 340 of the feces and urine distinction part 300 to open and close the urine flushing adjustment hole 243 and to adjust the amount of the air introduced into the guide rib 210 when the toilet user leaves the toilet seat.

The flushing adjustment part 220 includes: an air inflow adjustment member 221 configured to ascend and descend inside of the guide rib 210 and pass through a through-hole 221*a* so that the toilet paper time and flushing distinction protrusion 213 is coupled thereto; a seating cover 222 configured to be seated on an upper surface of the air inflow adjustment member 221; a flush washer 223 configured to be mounted on the air inflow adjustment member 221 to support the restoration spring 224; the restoration spring 224 configured to be mounted on the air inflow adjustment member 221 so as to be in close contact with the flush washer 223; a separation prevention member 225 configured to be mounted on a lower end of the air inflow adjustment member 221 to compress the restoration spring 224 in conjunction with the descending motion of the toilet seat 10 while preventing the restoration spring 224 from being separated and have an outer peripheral surface thereof on which a distinction pin control groove 225*a* is formed; and a feces amount adjustment bolt 227 configured to have an adjustment filter 227' mounted therein and coupled to the lower inner side of the air inflow adjustment member 221 to adjust an amount of air introduced into the through-hole 221*a*, and have an interior thereof through which a feces flushing adjustment hole 227" communicates.

The toilet paper time adjustment part 230 includes: a toilet paper time adjustment bolt 231 configured to be mounted on the lower part of the guide rib 210, be equipped with an adjustment filter 231' to control the amount of the air introduced into the guide rib 210, and have an inside thereof through which a toilet paper time adjustment hole 231" communicates; and a toilet paper time adjustment hole 232 configured to communicate the toilet paper time adjustment bolt 231 and the inside of the guide rib 210.

The urine flushing adjustment part 240 includes: a urine flushing distinction pin 241 configured to be mounted on the distinction pin control groove 225*a* of the flushing adjustment part 220 and determine a state as urination when a urine flushing adjustment hole 243 is not closed; a urine flushing adjustment bolt 242 configured to have an adjustment filter 242' mounted on a lower part of the guide rib 210 on one side of the toilet paper time adjustment part 230, so as to adjust the amount of the air introduced into the guide rib 210, and have a urine flushing adjustment hole 242" communicating therein; and the urine flushing adjustment hole 243 configured to communicate insides of the urine flushing adjustment bolt 242 and the guide rib 210.

The feces and urine distinction part 300 includes: a distinction guide rib 310 configured to protrude from the cover 120 of the detection switch 100 and have an inflow through-hole 311 penetrating therethrough; a discharge check valve 320 configured to open and close the inflow through-hole 311 of the distinction guide rib 310; a guide rod 330 configured to be embedded in the distinction guide rib 310 and discharge air inside the distinction guide rib 310 to a guide through-hole 330*a* while moving by the pressure of a guide spring 330' in conjunction with the descending motion of the toilet seat 10; a feces and urine determination member 340 configured to protrude from one side of the guide rod 330 and press the urine flushing distinction pin 241; and a discharge amount adjustment bolt 350 configured to be fastened to a lower inner side of the guide rod 330, have an adjustment filter 350' mounted thereon so as to control an amount of air discharged to the guide through-hole 330*a*, and have a discharge adjustment hole 350" communicating the inside of the distinction guide rib 310.

The flushing opening/closing portion 400 includes: a flushing guide member 410 configured to have a water supply hole 411 formed therein and connected to a pressure chamber of a flush valve 20 and a flushing hose 411', have a water drain hole 412 formed on one side of the water supply hole 411 and connected to a water drain hose 412', and have a water drain path 413 formed on an upper part of the water supply hole 411 and the water drain hole 412 so as to allow the water supply hole 411 and the water drain hole 412 to communicate with each other; an opening/closing valve part 420 configure to be mounted inside the flushing guide member 410 having the water drain hole 412 formed therein, be released by rotation of the toilet paper time and flushing conveyance part 430 when the detection switch 100 returns due to the toilet user leaving the toilet seat, and drain the water from the pressure chamber while the first opening/closing valve 421 and the second opening/closing valve 422 descend; the toilet paper time and flushing conveyance part 430 configured to be mounted on the cover 120 of the detection switch 100 and release a pressing force of the opening/closing valve part 420 while the pressurization release piece 226 of the flushing adjustment part 220 rotates the rotation release member 431 when the toilet user leaves the toilet seat; and a flushing guide cover 440 configured to be seated and fixed on an upper part of the flushing guide member 410 and seal the water drain path 413.

The opening/closing valve part 420 includes: a first opening/closing valve 421 configured to open the water supply hole 411 to convey the water in the pressure chamber while the pressurization release piece 226 of the toilet paper time control and flushing adjustment part 200 rotates the rotation release member 431 to release the pressing force of the opening/closing pin 421*a* when the toilet seat 10 ascends due to the toilet user leaving the toilet seat; and a second opening/closing valve 422 configured to flush the toilet by draining the pressure chamber's water entering through the first opening/closing valve 421 to the water drain hole 412 while the pressurization release piece 226 of the toilet paper time control and flushing adjustment part 200 rotates the rotation release member 431 to release the pressing force of the opening/closing pin 421*a* when the toilet seat 10 ascends due to the toilet user leaving the toilet seat, and block the water in the pressure chamber by closing the water drain hole 412 when the pressurization release piece 226 of the toilet paper time control and flushing adjustment part 200 rotates the rotation release member 431 to release the valve support plate 422*b* fixed to the water drain valve body 422*a*.

The first opening/closing valve 421 includes: an opening/closing pin 421*a* mounted from an upper part to a lower part of the water supply hole 411; a sealing member 421*b* mounted on the water supply hole 411 to seal when the opening/closing pin 421*a* ascends and descends; an elastic spring 421*c* configured to guide the opening and closing of the opening/closing pin 421*a*; and an opening/closing pin cover 421*d* configured to prevent separation of the opening/closing pin 421*a*.

The second opening/closing valve 422 includes: the water drain valve body 422*a* mounted from an upper part to an lower part of the water drain hole 412; a valve support plate 422*b* fixed to a lower end of the water drain valve body 422*a* at a lower part of the flushing guide member 410 and configured to support the water drain valve body 422*a* to ascend and descend; a support washer 422*c* mounted on the water drain hole 412 to prevent separation of the sealing member 422*c'* when the water drain valve body 422*a* ascends and descends; a packing 422*d* seated on an upper part of the water drain hole 412 inside the flushing guide member 410; and an opening/closing spring 422*e* mounted between the water drain valve body 422*a* and a flushing guide cover 440 to guide the opening and closing of the water drain valve body 422*a*.

The toilet paper time and flushing conveyance part 430 includes: a rotation release member 431 configured to be coupled to a shaft hole formed in the cover 120 of the detection switch 100 so as to rotate; a rotation guide protrusion 432 formed on one side of the rotation release member 431 to rotate the rotation release member 431 by the pressing force of the pressurization release piece 226; a support protrusion 433 protruding to the outside of the rotation release member 431 to be spaced apart from each other by a predetermined angle to support the first opening/closing valve 421 and the second opening/closing valve 422; and an elastic spring 434 mounted between the rotation release member 431 and the cover 120 to restore the rotation release member 431.

The flushing opening/closing portion 400 is integrally mounted on the upper part of the detection switch 100 and is modularized.

The following describes the operation process of the present disclosure configured as described above.

First, the embodiment of the present disclosure operates only with the toilet paper time control and flushing adjustment part 200 and the flushing opening/closing portion 400, or operates only with the toilet paper time control and flushing adjustment part 200, the feces and urine distinction part 300, and the flushing opening/closing portion 400, but here, the operation process will be described by limiting to the configuration including the toilet paper time control and flushing adjustment part 200, the feces and urine distinction part 300, and the flushing opening/closing portion 400.

The toilet paper time control and flushing adjustment part 200 and the feces and urine distinction part 300 are mounted between the cover 120 and the detection plate 130 of the detection switch 100 to form a single module, and a waterproof cover is mounted on the lower part of the detection switch 100.

The detection switch 100 is provided with a mounting and fixing part (not shown) to be elastically mounted in the installation hole of the toilet seat 10, and since the installation method of the detection switch 100 is the same as the method described in the Korean Patent No. 10-1647808, which is applied and registered by the applicant of the present application, a detailed description thereof will be omitted.

Figure 5:
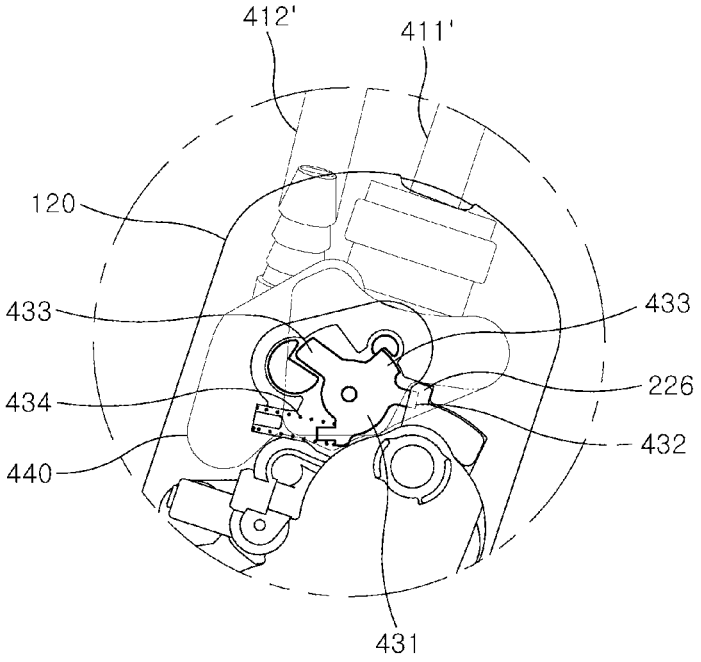
FIGS. 5 to 9 are views illustrating operation states when a toilet user is seated on a toilet seat to which the present disclosure is applied.

When the toilet seat 10 on which the detection switch 100 is mounted is seated on the toilet body, and the water drain hose 412' is connected to the water drain hole 412 so that the water in the pressure chamber is discharged to the toilet body at the same time as the water supply hole 411 of the flushing opening/closing portion 400 and the pressure chamber of the flush valve 20 are connected to the flushing hose 411', the installation of the present disclosure is completed as shown in FIG. 5.

Figure 6:
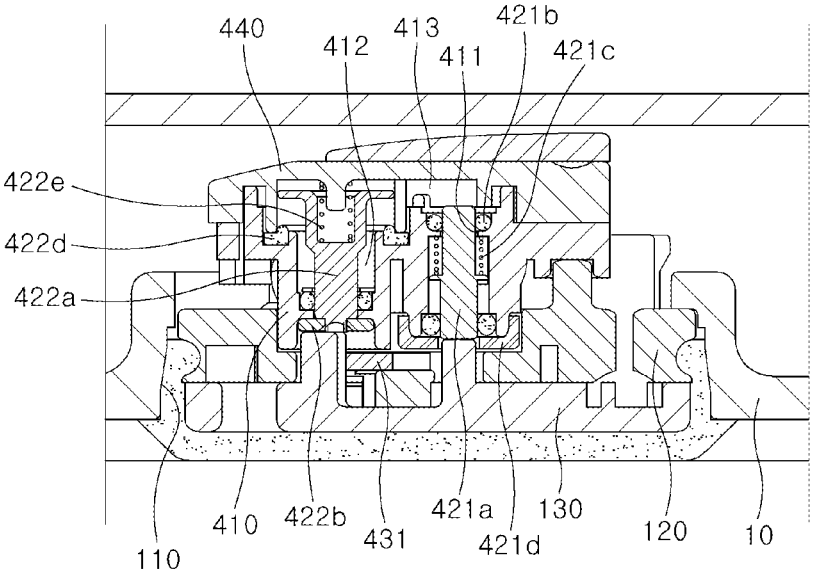

As shown in FIGS. 5 to 6, when a toilet user is seated on the toilet seat 10, as the toilet seat 10 moves downward by the weight load of the toilet user, the cover of the detection switch 100 compresses the seat spring 140 positioned between the cover 120 and the detection plate 130.

In addition, as the pressurization release piece 226 formed in the flushing adjustment part 220 is moved upward by the ascending of the toilet paper time control and flushing adjustment part 200, the upper end of the detection plate 130 of the detection switch 100 presses the lower part of the valve support plate 422*b* of the second opening/closing valve 422 and the lower part of the opening/closing pin 421*a* of the first opening/closing valve 421 while the rotation release member 431 mounted on the cover 120 rotates to a support position with the restoring force of the elastic spring 434 around the shaft hole, so as to close the water supply hole 411 and open the water drain hole 412, whereby the water in the pressure chamber is prepared to be drained into the toilet body.

At this time, the water drain valve body 422*a* of the second opening/closing valve 422 ascends while compressing the opening/closing spring 422*e* to communicate the water drain hole 412 and the water drain path 413, and since the water supply hole 411 is closed by the opening/closing pin 421*a*, the water is not supplied from the flush valve 20.

Figure 7:
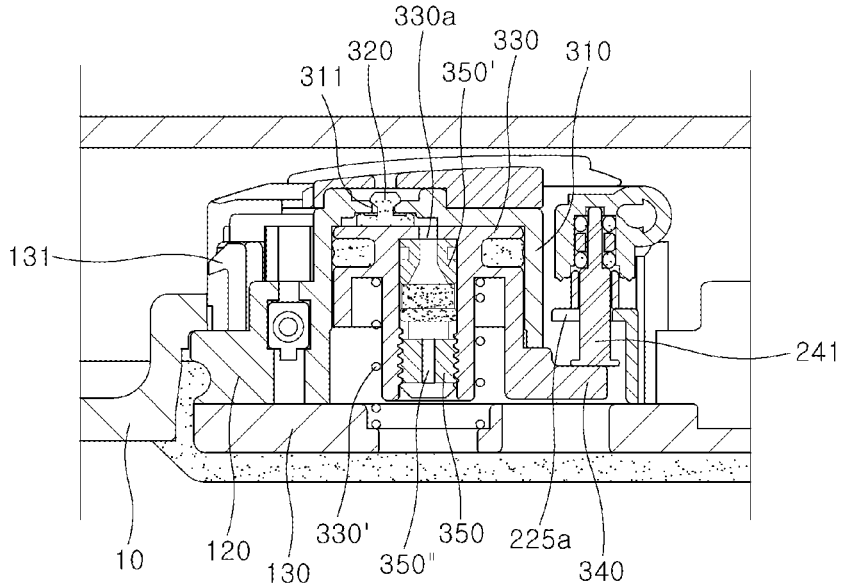
Figure 8:
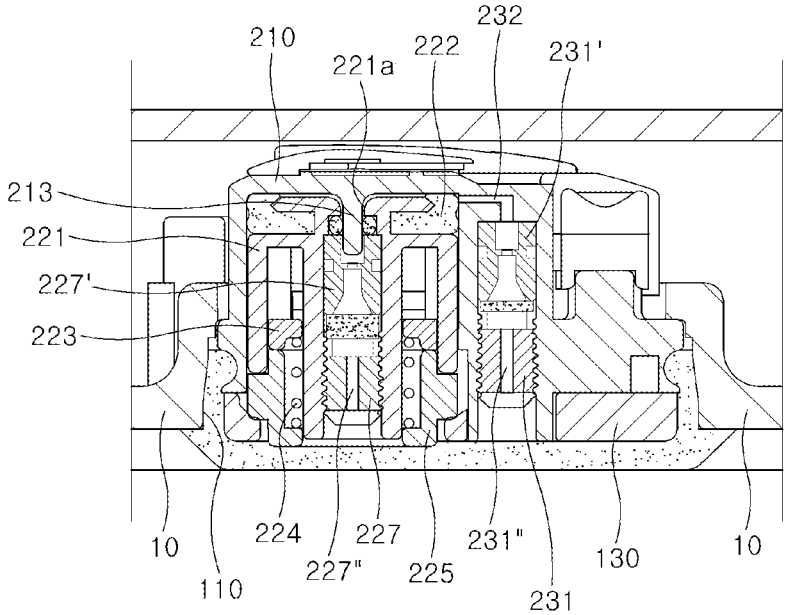
Figure 9:
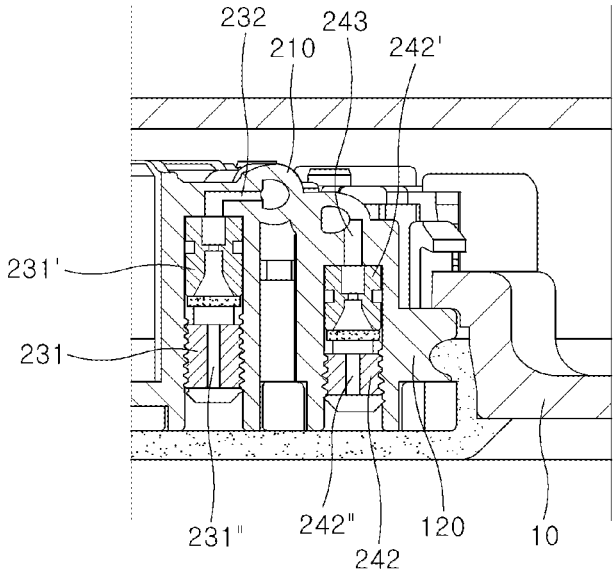

In addition, as the toilet seat 10 moves downward, the toilet paper time control and flushing adjustment part 200 ascends, and at the same time, as shown in FIGS. 7 to 9, in conjunction with the descending motion of the toilet seat 10, the flushing adjustment part 220 of the toilet paper time control and flushing adjustment part 200 moves to an inner upper end of the guide rib 210, so that the air inside the guide rib 210 passes through the discharge through-hole 211 and is discharged to the outside through the inflow check valve 212 at the same time, whereby the toilet paper time and flushing distinction protrusion 213 formed in the guide rib 210 closes the through-hole 221*a* of the air inflow adjustment member 221.

Here, the inflow check valve 212 is opened when the weight load is applied to the toilet seat 10 to discharge the air inside the guide rib 210 to the outside, and is closed when the weight load of the toilet seat is released to block the inflow of air into the interior of the guide rib 210.

When the air inflow adjustment member 221 moves to an upper part of the guide rib 210, the separation prevention member 225 compresses the restoration spring 224 in close contact with the flush washer 223. Since the flush washer 223 is caught by the guide rib 210, it is possible to maintain the compression force of the restoration spring 224 according to the movement of the separation prevention member 225.

In addition, due to the pressurizing of the guide spring 330' compressed in conjunction with the descending motion of the toilet seat 10, the feces and urine determination member 340 of the feces and urine distinction part 300 moves to an inner upper end of the distinction guide rib 310 and presses a urine flushing distinction pin 241 upward, and the air inside the distinction guide rib 310 is not discharged through the inflow through-hole 311 closed by the discharge check valve 320, but is discharged through a discharge amount adjustment bolt 350 in which the guide through-hole 330*a* and the discharge amount adjustment hole 350" are formed.

When the weight load of the toilet user is applied, the discharge check valve 320 closes the inflow through-hole 311 to block the inflow of air into the distinction guide rib 310, and when the weight load of the toilet user is released, the discharge check valve 320 opens the inflow through-hole 311 to discharge the air inside the distinction guide rib 310 to the outside.

While fastened to the guide through-hole 330*a* of the guide rod 330, the discharge amount adjustment bolt 350 not only compresses an adjustment filter 350' but also adjust an amount of air moving through the adjustment filter 350' according to the compression force of the adjustment filter 350'.

In addition, as the air inside a distinction guide protrusion 310 is discharged to the discharge amount adjustment bolt 350, the feces and urine determination member 340 formed on one side of the guide rod 330 presses the urine flushing distinction pin 241 mounted in the distinction pin control groove 225*a* upward, and when the urine flushing distinction pin 241 is unable to close the urine flushing adjustment hole 243, it is determined as urination.

When it is not possible to close the urine flushing adjustment hole 243 as described above, since air is suctioned to the always open toilet paper time adjustment hole 232 and urine flushing adjustment hole 243 at the same time, the guide rod 330 moves quickly so that the urination toilet paper time is applied, and when it is a flushing section, since the air is suctioned to the toilet paper time adjustment hole 231", the feces flushing adjustment hole 227", and the urine flushing control hole 242" at the same time, which are always open, the guide rod 330 moves quickly so that the amount of water becomes the urination flushing amount of the water.

In addition, when the feces and urine determination member 340 closes the urine flushing adjustment hole 243 by pressing the urine flushing distinction pin 241 mounted on the distinction pin control groove 225*a* upward, it is determined as defecation.

When the urine flushing adjustment hole 243 is closed as described above, air is not suctioned into the urine flushing adjustment hole 243, but the air is suctioned only through the toilet paper time adjustment hole 232, so the guide rod 330 moves relatively slowly.

Figure 10:
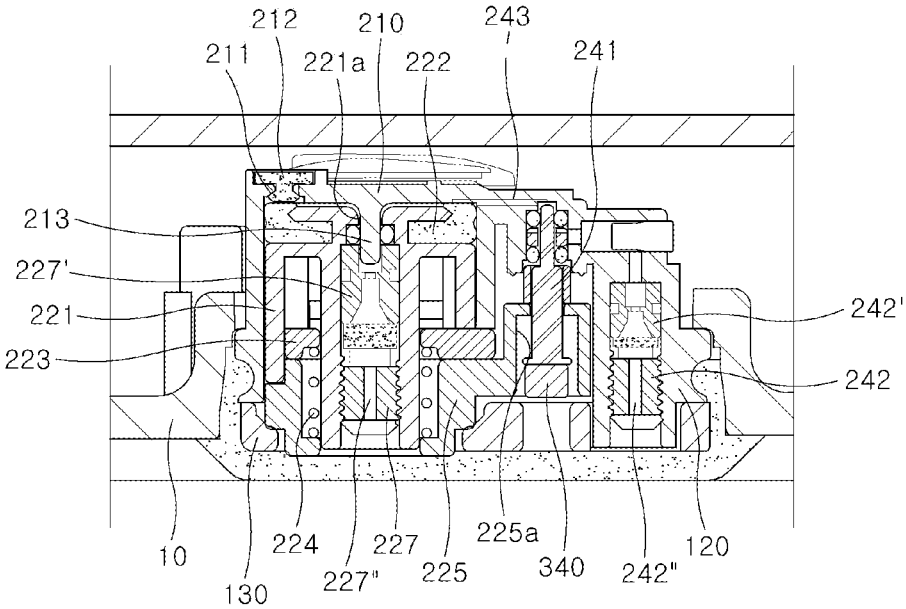
FIGS. 10 to 12 are views illustrating operation states in which defecation and urination of the toilet user are distinguished by a feces and urine distinction part of the present disclosure and toilet paper time and flushing is adjusted by a toilet paper time control and flushing adjustment part.
Figure 11:
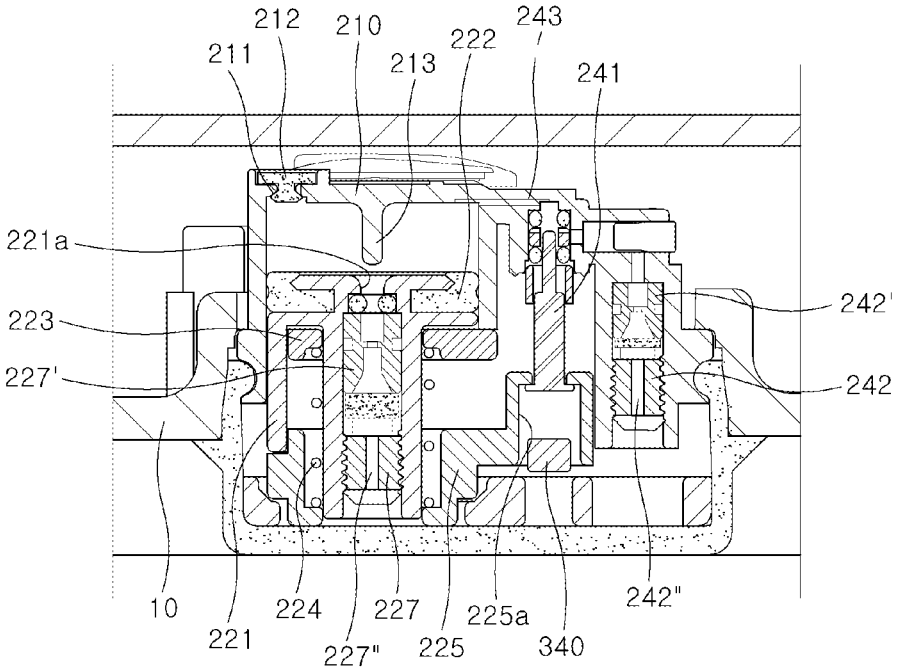
Figure 12:
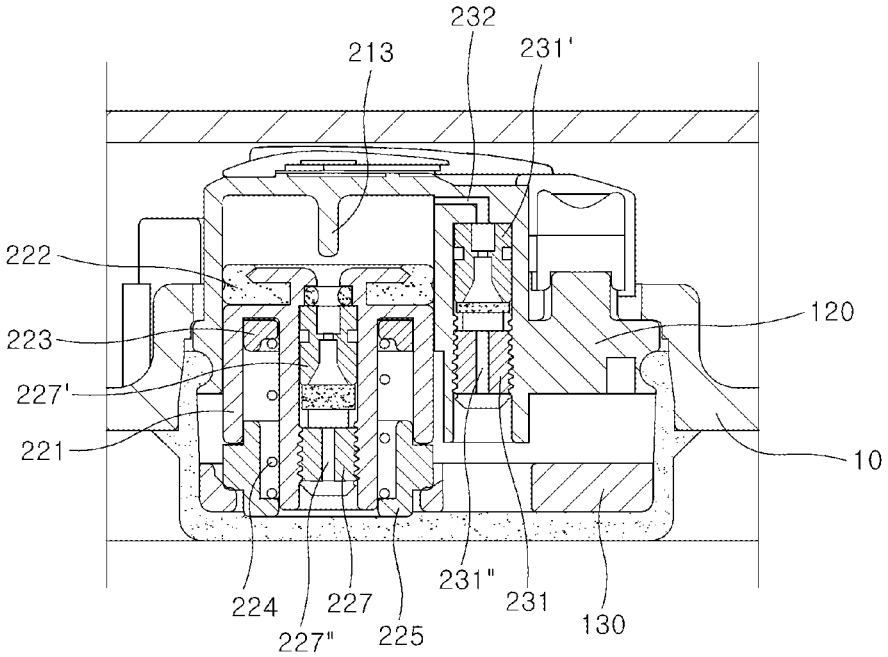
Figure 13:
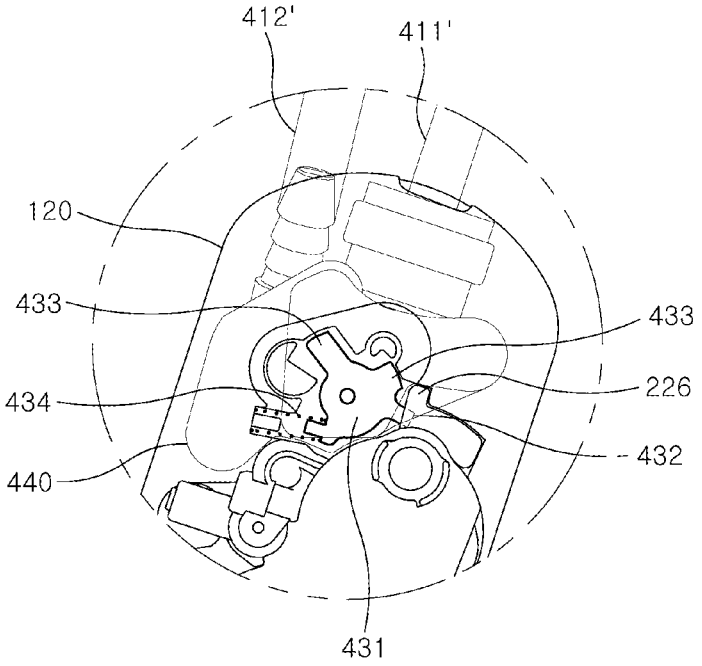
FIGS. 13 to 16 are views illustrating operation states in which excreta is flushed as the toilet user leaves the toilet seat to which the present disclosure is applied.
Figure 14:
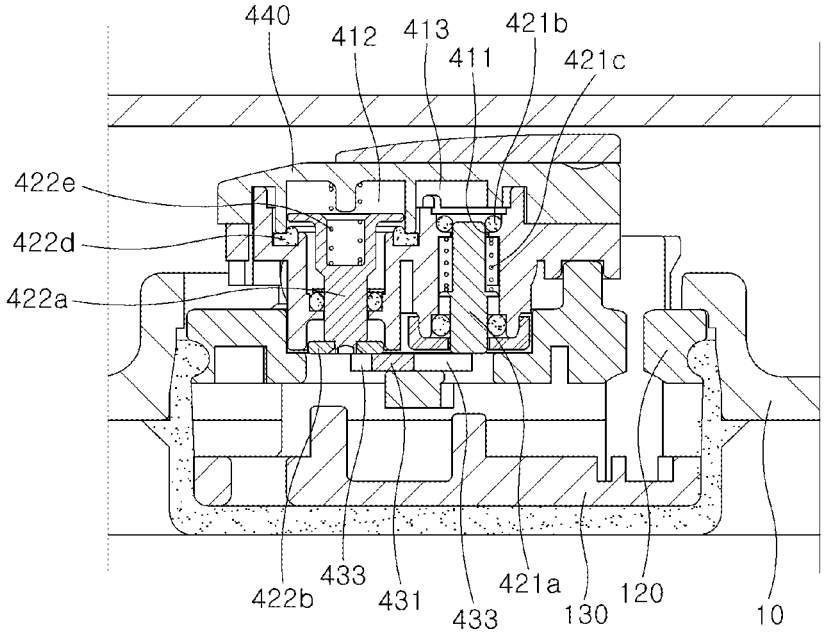
Figure 15:
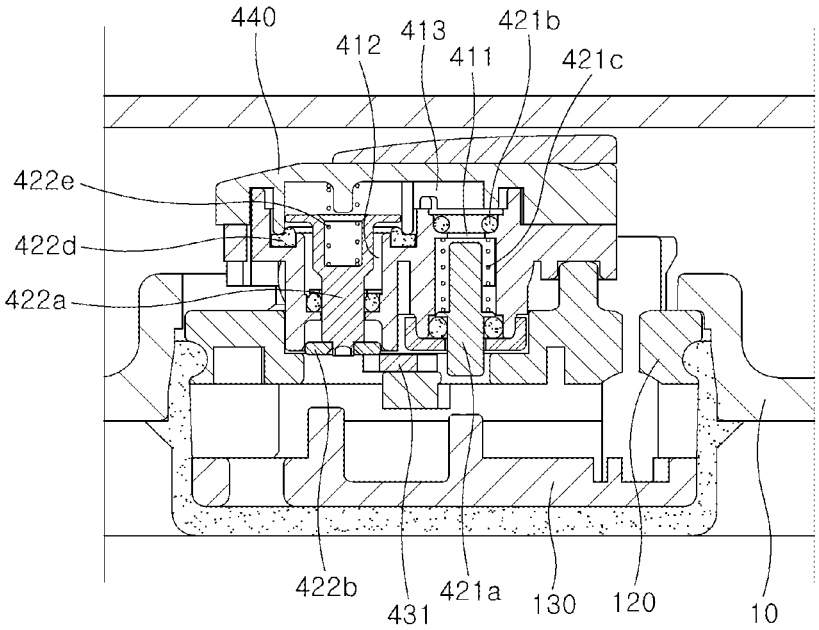
Figure 16:
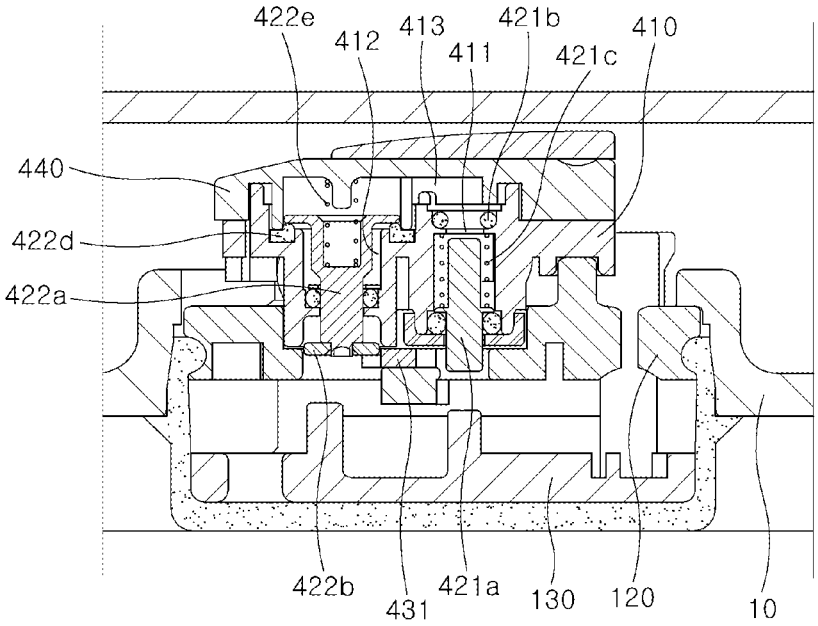

In addition, when a toilet user is seated on the toilet seat 10 leaves after excretion, as shown in FIGS. 10 to 12, the toilet seat 10 ascends with the restoring force of the seat spring 140.

At this time, the air inflow adjustment member 221 of the toilet paper time control and flushing adjustment part 200 moves to a lower end of the guide rib 210 by the restoring force of the restoration spring 224, and since the inflow check valve 212 closes the discharge through-hole 211 formed in the guide rib 210, the air is introduced into the guide rib 210 only through the feces amount adjustment bolt 227, the toilet paper time adjustment part 230, and the urine flushing adjustment part 240.

That is, in a case where the excretion of the toilet user is determined as the urination, the air is introduced into the guide rib 210 through the feces amount adjustment bolt 227 mounted on the air inflow adjustment member 221, the air is introduced into the guide rib 210 through the toilet paper time adjustment bolt 231 and the toilet paper time adjustment hole 232, and at the same time, the air is introduced into the guide rib 210 through the urine flushing adjustment bolt 242 and the urine flushing adjustment hole 243.

In addition, in a case where the excretion of the toilet user is determined as the defecation, the air is not introduced through the urine flushing adjustment bolt 242, but the air is introduced into the guide rib 210 through the feces amount adjustment bolt 227 mounted on the air inflow adjustment member 221, and at the same time, the air is introduced into the guide rib 210 through the toilet paper time adjustment bolt 231 and the toilet paper time adjustment hole 232.

Here, in the air introduced into the feces amount adjustment bolt 227, an amount of air moving through the adjustment filter 227' may be adjusted according to the compression force by which the feces amount adjustment bolt 227 is fastened, and the toilet paper time adjustment bolt 231 and the urine flushing adjustment bolt 242 may also adjust an amount of air moving through according to the compression force by which the same are fastened.

In addition, as shown in FIGS. 13 to 16, when the air inflow adjustment member 221 moves to the lower end of the guide rib 210, an inclined surface of a pressurization release surface 226 formed in the toilet paper time control and flushing adjustment part 200 presses the rotation release member 431 of the toilet paper time and flushing conveyance part 430, and at the same time, the detection plate 130 is separated from the lower parts of the valve support plate 422*b* and the opening/closing pin 421*a*.

In this case, since the lower parts of the water drain valve body 422*a* of the flushing opening/closing portion 400 and the opening/closing pin 421*a* of the first opening/closing valve 421 are supported by the support protrusion 433 formed on the rotation release member 431, as the water supply hole 411 is in a closed state, the time to dispose of the toilet paper is applied.

In addition, when the rotation release member 431 is completely rotated around the shaft hole by the pressurization release surface 226, the support protrusion 433 is separated from the valve support plate 422*b* and the opening/closing pin 421*a*, and at the same time, the opening/closing pin 421*a* descends by the restoring force of the elastic spring 421*c* to open the water supply hole 411 regardless of the high water pressure, so that the water stored in the pressure chamber of the flush valve 20 is supplied to the water drain path 413 communicating the water supply hole 411 and the water drain hole 412, thereby discharging the water to the toilet body through the water drain hose 412'.

When water is discharged through the water drain hole 412 for a predetermined period of time, the water drain valve body 422*a* is restored by the restoring force of the opening/closing spring 422*e* mounted on the water drain valve body 422*a*, so as to close the water drain hole 412, whereby the water supply is stopped while closing the water drain hole 412.

As described above, although the present disclosure has been described by a limited exemplary embodiment and drawings, the terms or words used in the disclosure and claims should not be interpreted to be limited to a conventional or dictionary meaning, and should be interpreted as meanings and concepts corresponding to the technical spirit of the present disclosure. Therefore, the exemplary embodiment described in the present disclosure and the configurations shown in the drawings are only an exemplary embodiment of the present disclosure, and do not represent all the technical spirit of the present disclosure, and accordingly, it should be appreciated that various equivalents and modifications are possible, without departing from the scope of the accompanying claims of the present disclosure.

The invention claimed is:

1. An unpowered automatic flushing module for a flush valve having an integrated flushing opening/closing portion configured integrally with a detection switch (100) module, the unpowered automatic flushing module comprising:

the detection switch (100) configured to guide descending motion of a toilet seat (10) under a weight load of a toilet user, and allow the toilet seat (10) to ascend when the pressurized weight load is released as the toilet user leaves the toilet seat (10);

a toilet paper time control and flushing adjustment part (200) configured to discharge air inside a guide rib (210) while a flushing adjustment part (220) in conjunction with the descending motion of the toilet seat (10) ascends, and control time to dispose of toilet paper with feces and time to flush the feces while suctioning the air from outside through a toilet paper time adjustment hole (231") and a feces flushing adjustment hole (227") with a restoring force of a restoration spring (224) when the toilet user leaves the toilet seat after defecation; and the flushing opening/dosing portion (400) configured such that when the toilet seat (10) is descending, a first opening/closing valve (421) and a second opening/closing valve (422) ascend at the same time by the detection switch (100), so as to dose a water supply hole (411) by the first opening/closing valve (421) and open a water drain hole (412) by the second opening/closing valve (422), thereby preparing to drain water from a pressure chamber into a toilet body and allowing a rotation release member (431) to be inserted to support an opening/closing pin (421*a*) of the first opening/closing valve (421) and a water drain valve body (422*a*) of the second opening/dosing valve (422), the flushing opening/closing portion (400) being configured such that when the detection switch (100) is restored due to leaving of the toilet user from the toilet seat, the rotation release member (431) is pressed while the opening/closing pin (421*a*) of the first opening/dosing valve (421) and the water drain valve body (422*a*) of the second opening/closing valve (422) descend, and the rotation release member (431) is rotated while a pressurization release piece (226) of the toilet paper time control and flushing adjustment part (200) descends, thereby controlling toilet paper time until the opening/dosing pin (421*a*) of the first opening/closing valve (421) is released, the flushing opening/closing portion (400) being configured such that when the opening/closing pin (421*a*) of the first opening/closing valve (421) being pressurized is released by rotating the rotation release member (431) while the pressurization release piece (226) of the toilet paper time control and flushing adjustment part (200) descends, since the water supply hole (411) is opened regardless of high water pressure and simultaneously the water drain valve body (422*a*) of the second opening/closing valve (422) opens the water drain hole (412), thereby flushing a toilet while draining the water stored in the pressure chamber of a flush valve (20) into the toilet body, and the flushing opening/dosing portion (400) being configured such that when a pressurizing force of the water drain valve body (422*a*) of the second opening/dosing valve (422) is released by rotating the rotation release member (431) while the pressurization release piece (226) of the toilet paper time control and flushing adjustment part (200) is descending, the water stored in the pressure chamber of the flush valve (20) is prevented from being drained, thereby stopping the toilet flushing.

2. The unpowered automatic flushing module of claim 1, wherein the detection switch (100) comprises:

an installation hole (110) formed on the toilet seat;

a cover (120) mounted on the installation hole (110) so as to allow a hook (131) protruding from a detection plate (130) to be coupled to a hook coupling hole (121) penetrating the cover (120);

the detection plate (130) mounted to the toilet body as the hook (131) is coupled to the hook coupling hole (121) penetrating the cover (120); and a seat spring (140) mounted between the cover (120) and the detection plate (130).

3. The unpowered automatic flushing module of claim 1, wherein the flushing opening/dosing portion (400) comprises:

a flushing guide member (410) configured to have the water supply hole (411) formed therein and be connected to the pressure chamber of the flush valve (20) and a flushing hose (411'), have the water drain hole (412) formed on one side of the water supply hole (411) and connected to a water drain hose (412'), and have a water drain path (413) formed on an upper part of the water supply hole (411) and the water drain hole (412) so as to allow the water supply hole (411) and the water drain hole (412) to communicate with each other;

an opening/closing valve part (420) configure to be mounted inside the flushing guide member (410) having the water drain hole (412) formed therein, be released by rotation of the toilet paper time and flushing conveyance part (430) when the detection switch (100) returns due to the toilet user leaving the toilet seat, and drain the water from the pressure chamber while the first opening/closing valve (421) and the second opening/dosing valve (422) descend;

the toilet paper time and flushing conveyance part (430) configured to be mounted on a cover (120) of the detection switch (100) and release a pressing force of the opening/closing valve part (420) while the pressurization release piece (226) of the flushing adjustment part (220) rotates the rotation release member (431) when the toilet user leaves the toilet seat; and a flushing guide cover (440) configured to be seated and fixed on an upper part of the flushing guide member (410) and seal the water drain path (413).

4. The unpowered automatic flushing module of claim 3, wherein the opening/closing valve part (420) comprises:

the first opening/closing valve (421) configured to open the water supply hole (411) to convey the water in the pressure chamber while the pressurization release piece (226) of the toilet paper time control and flushing adjustment part (200) rotates the rotation release member (431) to release the pressing force of the opening/dosing pin (421*a*) when the toilet seat (10) ascends due to the toilet user leaving the toilet seat; and the second opening/dosing valve (422) configured to flush the toilet by draining the water of the pressure chamber entering through the first opening/dosing valve (421) to the water drain hole (412) while the pressurization release piece (226) of the toilet paper time control and flushing adjustment part (200) rotates the rotation release member (431) to release the pressing force of the opening/closing pin (421*a*) when the toilet seat (10) ascends due to the toilet user leaving the toilet seat, and block the water in the pressure chamber by closing the water drain hole (412) when the pressurization release piece (226) of the toilet paper time control and flushing adjustment part (200) rotates the rotation release member (431) to release a valve support plate (422*b*) fixed to the water drain valve body (422*a*).

5. The unpowered automatic flushing module of claim 4, wherein the first opening/closing valve (421) comprises:

the opening/closing pin (421*a*) mounted from an upper part to a lower part of the water supply hole (411);

a sealing member (421*b*) mounted on the water supply hole (411) to seal when the opening/closing pin (421*a*) ascends and descends;

an elastic spring (421*c*) configured to guide the opening and closing of the opening/closing pin (421*a*), and an opening/closing pin cover (421*d*) configured to prevent separation of the opening/closing pin (421*a*).

6. The unpowered automatic flushing module of claim 4, wherein the second opening/dosing valve (422) comprises:

the water drain valve body (422*a*) mounted from an upper part to a lower part of the water drain hole (412);

the valve support plate (422*b*) fixed to a lower end of the water drain valve body (422*a*) at a lower part of the flushing guide member (410) and configured to support the water drain valve body (422*a*) to ascend and descend;

a support washer (422*c*) mounted on the water drain hole (412) to prevent separation of the sealing member (422*c'*) when the water drain valve body (422*a*) ascends and descends;

a packing (422*d*) seated on an upper part of the water drain hole (412) inside the flushing guide member (410); and an opening/closing spring (422*e*) mounted between the water drain valve body (422*a*) and the flushing guide cover (440) to guide the opening and dosing of the water drain valve body (422*a*).

7. The unpowered automatic flushing module of claim 3, wherein a toilet paper time and flushing conveyance part (430) comprises:

the rotation release member (431) configured to be coupled to a shaft hole formed in the cover (120) of the detection switch (100) so as to rotate;

a rotation guide protrusion (432) formed on one side of the rotation release member (431) to rotate the rotation release member (431) by the pressing force of the pressurization release piece (226);

a support protrusion (433) protruding to the outside of the rotation release member (431) to be spaced apart from each other by a predetermined angle to support the first opening/closing valve (421) and the second opening/closing valve (422); and an elastic spring (434) mounted between the rotation release member (431) and the cover (120) to restore the rotation release member (431).

8. The unpowered automatic flushing module of claim 1, wherein the flushing opening/closing portion (400) is integrally mounted on the upper part of the detection switch (100) and is modularized.

9. An unpowered automatic flushing module for a flush valve having an integrated flushing opening/closing portion configured integrally with a detection switch (100) module, the unpowered automatic flushing module comprising:

the detection switch (100) configured to guide descending motion of a toilet seat (10) under a weight load of a toilet user, and allow the toilet seat (10) to ascend when the pressurized weight load is released as the toilet user leaves the toilet seat (10);

a toilet paper time control and flushing adjustment part (200) configured to discharge air inside a guide rib (210) while a urine flushing adjustment (240) and a flushing adjustment part (220) in conjunction with the descending motion of the toilet seat (10) ascends, control time to dispose of toilet paper with feces and the flushing of the feces while suctioning the air from outside through a toilet paper time adjustment hole (231") and a feces flushing adjustment hole (227") with a restoring force of a restoration spring (224) when the toilet user leaves the toilet seat after defecation, and control the urine toilet paper time and urine flushing while rapidly suctioning the air from the outside through the toilet paper time adjustment hole (231"), the feces flushing adjustment hole (227"), and a urine flushing adjustment hole (242") when the toilet user leaves the toilet seat after urination;

a feces and urine distinction part (300) configured to adjust an amount of internal air discharged to the outside while a guide rod (330) moves into a distinction guide rib (310) in conjunction with the descending motion of the toilet seat (10), determine as urination when a urine flushing adjustment hole (243) is opened because a feces and urine determination member (340) fails to press the urine flushing determination pin (241), and determine as defecation when the feces and urine determination member (340) closes the urine flushing adjustment hole (243) by pressing the urine flushing determination pin (241); and the flushing opening/dosing portion (400) configured such that when the toilet seat (10) is descending, a first opening/closing valve (421) and a second opening/dosing valve (422) ascend at the same time by the detection switch (100), so as to dose a water supply hole (411) by the first opening/closing valve (421) and open a water drain hole (412) by the second opening/closing valve (422), thereby preparing to drain water from a pressure chamber into a toilet body and allowing a rotation release member (431) to be inserted to support an opening/closing pin (421*a*) of the first opening/dosing valve (421) and a water drain valve body (422*a*) of the second opening/dosing valve (422), the flushing opening/closing portion (400) being configured such that when the detection switch (100) is restored due to leaving of the toilet user from the toilet seat, the rotation release member (431) is pressed while the opening/closing pin (421*a*) of the first opening/dosing valve (421) and the water drain valve body (422*a*) of the second opening/closing valve (422) descend, and the rotation release member (431) is rotated while a pressurization release piece (226) of the toilet paper time control and flushing adjustment part (200) descends, thereby controlling toilet paper time until the opening/closing pin (421*a*) of the first opening/closing valve (421) is released, the flushing opening/closing portion (400) being configured such that when the opening/closing pin (421*a*) of the first opening/closing valve (421) being pressurized is released by rotating the rotation release member (431) while the pressurization release piece (226) of the toilet paper time control and flushing adjustment part (200) descends, since the water supply hole (411) is opened regardless of high water pressure and simultaneously the water drain valve body (422*a*) of the second opening/closing valve (422) opens the water drain hole (412), thereby flushing a toilet while draining the water stored in the pressure chamber of a flush valve (20) into the toilet body, and the flushing opening/dosing portion (400) being configured such that when a pressurizing force of the water drain valve body (422*a*) of the second opening/dosing valve (422) is released by rotating the rotation release member (431) while the pressurization release piece (226) of the toilet paper time control and flushing adjustment part (200) is descending, the water stored in the pressure chamber of the flush valve (20) is prevented from being drained, thereby stopping the toilet flushing.

10. The unpowered automatic flushing module of claim 9, wherein the toilet paper time control and flushing adjustment part (200) comprises:

the guide rib (210) configured to protrude from a cover (120) of the detection switch (100), have an inflow check valve (212) to open and dose a discharge through-hole (211) penetrating therein, and have an inner bottom surface thereof from which a toilet paper time and flushing distinction protrusion (213) protrudes;

the flushing adjustment part (220) configured to be embedded in the guide rib (210), discharge the air inside the guide rib (210) to the inflow check valve (212) that is opened in conjunction with the descending motion of the toilet seat, control the amount of the air introduced into the guide rib (210) while the inflow check valve (212) doses the discharge through-hole (211) in conjunction with the ascending motion of the toilet seat;

a toilet paper time adjustment part (230) configured to be mounted on the guide rib (210) on one side of the flushing adjustment part (220) and adjust the amount of the air introduced into the guide rib (210); and a urine flushing adjustment part (240) configured to ascend and descend by the feces and urine determination member (340) of the feces and urine distinction part (300) to open and close the urine flushing adjustment hole (243) and to adjust the amount of the air introduced into the guide rib (210) when the toilet user leaves the toilet seat.

11. The unpowered automatic flushing module of claim 10, wherein the flushing adjustment part (220) comprises:

an air inflow adjustment member (221) configured to ascend and descend inside of the guide rib (210) and pass through a through-hole (221*a*) so that the toilet paper time and flushing distinction protrusion (213) is coupled thereto;

a seating cover (222) configured to be seated on an upper surface of the air inflow adjustment member (221);

a flush washer (223) configured to be mounted on the air inflow adjustment member (221) to support the restoration spring (224);

the restoration spring (224) configured to be mounted on the air inflow adjustment member (221) so as to be in dose contact with the flush washer (223);

a separation prevention member (225) configured to be mounted on a lower end of the air inflow adjustment member (221) to compress the restoration spring (224) in conjunction with the descending motion of the toilet seat (10) while preventing the restoration spring (224)

from being separated and have an outer peripheral surface thereof on which a distinction pin control groove (225*a*) is formed; and a feces amount adjustment bolt (227) configured to have an adjustment filter (227') mounted therein and coupled to a lower inner side of the air inflow adjustment member (221) to adjust an amount of air introduced into the through-hole (221*a*), and have an inside thereof through which the feces flushing adjustment hole (227") communicates.

12. The unpowered automatic flushing module of claim 10, wherein the toilet paper time adjustment part (230) comprises:

a toilet paper time adjustment bolt (231) configured to be mounted on a lower part of the guide rib (210), be equipped with an adjustment filter (231') to control the amount of the air introduced into the guide rib (210), and have an inside thereof through which a toilet paper time adjustment hole (231") communicates; and a toilet paper time adjustment hole (232) configured to communicate the toilet paper time adjustment bolt (231) and the inside of the guide rib (210).

13. The unpowered automatic flushing module of claim 10, wherein the urine flushing adjustment part (240) comprises:

a urine flushing distinction pin (241) configured to be mounted on a distinction pin control groove (225*a*) of the flushing adjustment part (220) and determine a state as urination when the urine flushing adjustment hole (243) is not dosed;

a urine flushing adjustment bolt (242) configured to have an adjustment filter (242') mounted on a lower part of the guide rib (210) on one side of the toilet paper time adjustment part (230), so as to adjust the amount of the air introduced into the guide rib (210), and have the urine flushing adjustment hole (242") communicating therein; and the urine flushing adjustment hole (243) configured to communicate insides of the urine flushing adjustment bolt (242) and the guide rib (210).

14. The unpowered automatic flushing module of claim 9, wherein the feces and urine distinction part (300) comprises:

the distinction guide rib (310) configured to protrude from a cover (120) of the detection switch (100) and have an inflow through-hole (311) penetrating therethrough;

a discharge check valve (320) configured to open and dose the inflow through-hole (311) of the distinction guide rib (310);

the guide rod (330) configured to be embedded in the distinction guide rib (310) and discharge the air inside the distinction guide rib (310) to a guide through-hole (330*a*) while moving by the pressure of a guide spring (330') in conjunction with the descending motion of the toilet seat (10);

the feces and urine determination member (340) configured to protrude from one side of the guide rod (330) and press the urine flushing distinction pin (241); and a discharge amount adjustment bolt (350) configured to be fastened to a lower inner side of the guide rod (330), have an adjustment filter (350') mounted thereon so as to control the amount of the air discharged to the guide through-hole (330*a*), and have a discharge adjustment hole (350") communicating an inside of the distinction guide rib (310).

* * * * *